US005333566A

United States Patent [19]

Wasowski, Jr.

[11] Patent Number: 5,333,566

[45] Date of Patent: Aug. 2, 1994

[54] SPINNAKER GYBING APPARATUS

[76] Inventor: Stanley F. Wasowski, Jr., 716 Holly Dr. North, Annapolis, Md. 21401

[21] Appl. No.: 60,641

[22] Filed: May 13, 1993

[51] Int. Cl.[5] ..... B63H 5/08

[52] U.S. Cl. ..... 114/102

[58] Field of Search ..... 114/89, 102, 103, 97, 114/98

[56] References Cited

U.S. PATENT DOCUMENTS

| | | | |
|---|---|---|---|
| 3,185,121 | 5/1965 | Nilsen | 114/102 X |
| 4,292,910 | 10/1981 | Hoyt | 114/102 |
| 4,473,021 | 9/1984 | Aronowitsch | 114/89 X |
| 4,501,217 | 2/1985 | Hoyt | 114/102 |

*Primary Examiner*—Sherman Basinger

[57] ABSTRACT

A specialized spinnaker pole shell fitting consisting of two half shell units which are assembled around an ordinary spinnaker pole of constant cross section to be attached to the mast of a sailboat. The shell is provided with roller bearings to permit the spinnaker pole to be facilely moved perpendicularly to the longitudinal axis of the sailboat over the complete length of the pole. Control fines are provided to control the longitudinal movement of the pole, to have the end furthest from the mast raised or lowered, and to have the end furthest from the mast moved forward or aft. In an optional configuration, with a stowage bracket is provided to permit the spinnaker pole to be stowed in a vertical orientation parallel to and next to the mast. All these features are accomplished by lines led to the cockpit of the sailboat so that the complete operation of gybing the spinnaker may be accomplished without sending a crewman to the foredeck.

11 Claims, 13 Drawing Sheets

SPINNAKER GYBING APPARATUS

FIELD OF THE INVENTION

The present invention is directed to a novel spinnaker sailing device, more particularly, the present invention is directed to an improved device which allows a sailboat spinnaker to be gybed without leaving the cockpit. The present invention also allows the spinnaker pole to be stored, ready to use, vertically, against the mast, as opposed to the customary on deck stowage. The present invention permits an ordinary spinnaker pole to be moved through the apparatus at the mast so that the spinnaker can be flown on the other side of the boat without disconnecting the pole from the mast, or dipping the pole under the forestay. It also eliminates the need for attaching and detaching the spinnaker sheets from the pole end with every gybe.

BACKGROUND OF THE INVENTION

In practice, wind powered boats rarely sail directly down wind. Most often, sailboats travel in directions oblique to the direction of the wind. The limitations of waterway boundaries and other obstacles often require sailboats to travel in a zig-zag pattern centered on the direction of desired travel. Each change of direction in this maneuver which causes the sailboat to present its opposite side to the wind, with the wind crossing over the rear or stem end of the sailboat, is known as a "gybe." (When the wind comes over the front or bow of the sailboat, the maneuver is called a "tack.")

In order to gybe, a set of procedures must be executed by the crew which range from simple to complex depending on which sails the sailboat has set. In general, in order to gybe the direction of the boat must be changed relative to the direction of the wind so that the wind comes over the opposite side of the sailboat. In addition, the sails must be reconFigured so that they billow out towards the opposite side of the sailboat. When engaged in competitive sailing, this operation must be carried out with speed and efficiency. Further, when sailing singlehandedly, it is preferable for all operations to be executable from the cockpit so that control of the sailboat may be maintained.

Sailboats may be fitted with a variety of different sails depending on the wind conditions and the direction of sail. Sails are chosen for a particular set of conditions and then any sail may be adjusted in terms of its shape and set to maximize the force derived from the wind. When sailing downwind, a spinnaker is often used. FIG. 1 is an illustration of the prior art. A spinnaker is a large triangular sail, the uppermost corner of which or "head" 101 is attached to the top of the mast by a halyard 109. The lower corner of the spinnaker 102 which lies downwind is attached to a control line, called a spinnaker sheet 104, the free end of which is led to the cockpit, by means of which the shape and tension (set of the sail may be controlled. The lower corner of the spinnaker which lies upwind 103 is attached to another spinnaker sheet 105 which is led to the outboard end 106 of the spinnaker pole 110, and thence to the cockpit. The inboard end 107 of the spinnaker pole is attached to the mast 22. The spinnaker pole is supported by a control line 111, called a topping lift. The topping lift 111, together with the downhaul 112 control height of the outboard end of the spinnaker pole 106. The spinnaker pole holds the upwind portion of the spinnaker into the wind and the position of the spinnaker pole in relation to the rest of the sailboat is a factor in determining the shape and set of the spinnaker, and thus the efficiency of the spinnaker's operation.

When a gybe is executed while using the spinnaker, the spinnaker presents its opposite side to the wind. For the sail to operate properly, the spinnaker pole must now hold the opposite corner of the spinnaker into the wind. When a spinnaker is gybed in the conventional manner, one of two procedures is followed:

1. End for End Gybe.

On an end for end gybe, the spinnaker sheet 105 holding the upwind corner of the spinnaker to the pole is released from the outboard end 106 of the spinnaker pole. Then the pole 110 is disconnected from the mast and the inboard end 107 of the spinnaker pole is swung outboard. While it is being swung outboard, the other spinnaker sheet 104, which is attached to the opposite corner of the spinnaker 102, is attached to the end of the pole going outboard 107. Finally, the new inboard end 106, is reattached to the mast 22. This type of gybe does not require the vertical height of the pole to be adjusted during the evolution of the maneuver.

2. Dip Pole Gybe.

On a dip pole gybe, the sheet 105 holding the upwind corner of the spinnaker 103 is released from the outboard end 106 of the spinnaker pole. The pole is then swung through the foretriangle to the other side of the boat, as shown in FIG. 2, according to prior art. The foretriangle is the triangular area of the sailboat formed by the mast 22, the forestay 120 and the foredeck. Because the spinnaker pole would hit the forestay 120 if it were merely swung through the foretriangle while held in a horizontal position by the topping lift 111, the vertical position of the spinnaker pole must be reduced by easing out the topping lift 111 to allow the outboard end of the pole 106 to dip down to near deck level so it can fit inside the forestay. (On some sailboat configurations, the geometry of the foretriangle is such that the inboard end 107 of the spinnaker pole must be raised as well by sliding the attachment ring 108 up the mast along its track 23 to allow sufficient angle to swing the spinnaker pole through the foretriangle. The attachment ring 108 must then be slid down the track 23 to its original location.) After the pole is swung through to the opposite side, the sheet 104 attached to the opposite corner 102 of the spinnaker is attached to the outboard end of the pole 106. This type of gybe does not require the pole to be detached from the mast.

Both methods of gybing require one or more crewmembers to be on the foredeck to handle the pole. In addition, the dip pole gybe requires another crewmember to adjust the topping lift while the pole is being swung through the foretriangle to the other side of the vessel. The complexity of this maneuver provides many opportunities for mistakes which can cost speed in racing situations, and in rough seas, operations performed on a pitching foredeck can be quite dangerous. Disconnecting and reconnecting the pole to the mast is cumbersome and time consuming. Many injuries to crew members occur during this operation as the pressure to conserve time in racing situations lead to accidents. Further, the need to manually handle the spinnaker pole prevents a lone sailor from performing this maneuver in most cases. For a lone sailor to perform a spinnaker gybe, he must leave the cockpit and climb up to the foredeck, leaving no one to steer the boat through the gybing maneuver.

DESCRIPTION OF THE PRIOR ART

There have been other attempts to solve the problems associated with conventional spinnaker pole structures. One attempt was proposed by Hoyt in U.S. Pat. No. 4,292,910. The device disclosed in Hoyt consists of a bow mounted swiveling post upon which a hollow tube is mounted. The spinnaker pole is inserted within the hollow tube, permitting the swiveling action to accommodate the spinnaker on either side of the boat. This proposal suffers from several disadvantages. The conspicuous mounting of the Hoyt device will make it difficult to accommodate on the bow of a sailboat. Further, the spinnaker pole must be manually inserted into the device before each spinnaker run, again requiting one of the crew to venture out onto the bow. Still further, no provision is made to move the spinnaker pole within the device to fly more of the spinnaker on one side of the boat or the other.

A further example of prior attempts to facilitate operations under a spinnaker sail was proposed by Aronowistch in U.S. Pat. No. 4,473,021. This device consists of a track and follower arrangement fashioned directly onto a specialized spinnaker boom. The follower portion of the device is mounted onto the mast of the sailboat and the spinnaker boom may then be moved laterally across the boat. This proposal suffers from the requirement that a specialized spinnaker boom be fabricated to accommodate the follower mechanism. Further, installation of the boom requires a complex mating procedure, again requiting substantial crew attention and effort.

A still further attempt was proposed by Gevalt in U.S. Pat. No. 413,046. The Gevalt device facilitated a variation of the dip-pole gybe, however, instead of the outboard end of the spinnaker pole being passed under the forestay near the bow, it was lifted vertically and rotated, passing under the forestay near the masthead. Gevalt proposed making a hole in the deck into which the inboard end of the spinnaker pole could be inserted and lowered to allow the outboard end of the spinnaker boom to pass under the forestay as it was swung from one side of the vessel to the other. The Gevalt device limits the length of the spinnaker pole which may be used by the height of the attachment point of the forestay to the mast, in addition to having the obvious disadvantage of requiting a hole to be made in the deck. Moreover, a crewmember is still required to be on the foredeck to detach the spinnaker sheet from the pole before it is swung to the opposite side of the vessel and attach the other spinnaker sheet to the pole afterwards.

An attempt to facilitate downwind sailing was proposed by Godfrey in U.S. Pat. No. 4,367,688. The Godfrey device utilizes two matching booms which carry individual sails and may be swiveled about the mast. To simulate a spinnaker sail in operation, each boom is extended on opposite sides of the boat, presenting a large downwind sail surface. Swinging the upwind boom forward of the mast, as is required for use with a spinnaker, is impractical on a conventional sailboat using the Godfrey configuration as the shrouds, the stays which control the lateral movement of the mast, would interfere with such a maneuver.

Another attempt to facilitate spinnaker handling was proposed by Crandall in U.S. Pat. No. 383,172. Crandall proposed a two piece spinnaker pole which could be extended to accommodate a large spinnaker, but contracted to permit the spinnaker pole to swing below the forestay in a dip pole gybe. The Crandall device, however, required crew members to be on the foredeck to maneuver the spinnaker pole as well as to perform the pole contraction and extension operations as part of the gybe.

As will be understood, the improved spinnaker pole handling apparatus of this invention or "STOSH Box" (STOSH studs for Simplified Technique for Optimum Spinnaker Handling), referred to herein as a spinnaker pole shell, overcomes many of the disadvantages of the prior art. The difficulties and limitations suggested in the preceding are not intended to be exhaustive but rather are among the many which may tend to reduce the effectiveness and user satisfaction with prior spinnaker handling devices and the like. Other noteworthy problems may also exist. However, those presented above should be sufficient to demonstrate that prior spinnaker boom handling devices appearing in the past will admit to worthwhile improvement.

SUMMARY OF THE INVENTION

In contrast to the prior art devices which have attempted to address the need for a more efficient spinnaker pole handling apparatus, the present invention is particularly, although not exclusively, adapted for use on sailboats engaged in the use of spinnaker sails.

In its preferred embodiment, the present invention is designed to alleviate the inherent hazards and pitfalls associated with use of a spinnaker sail in gybing maneuvers using prior art devices. A primary advantage of the present invention is that it will permit the gybing of the spinnaker without detaching any line or fitting. Further, the present invention will permit a single sailor to gybe the spinnaker without leaving the cockpit.

The present invention consists of a specialized fitting, the spinnaker pole shell, and its associated tackle, which will permit an ordinary spinnaker pole of constant cross section to be attached to the mast of a sailboat, to be moved perpendicularly to the longitudinal axis of the sailboat over the complete length of the pole, to have the end furthest from the mast raised or lowered, to have the end furthest from the mast moved forward or aft; and in an optional configuration, with a stowage bracket, to be stowed in a vertical orientation parallel to and next to the mast. All these features are accomplished by means of lines led to the cockpit of the sailboat so that the complete operation of gybing the spinnaker may be accomplished without sending a crewman m the foredeck.

DETAILED DESCRIPTION OF THE INVENTION

Figure 3:
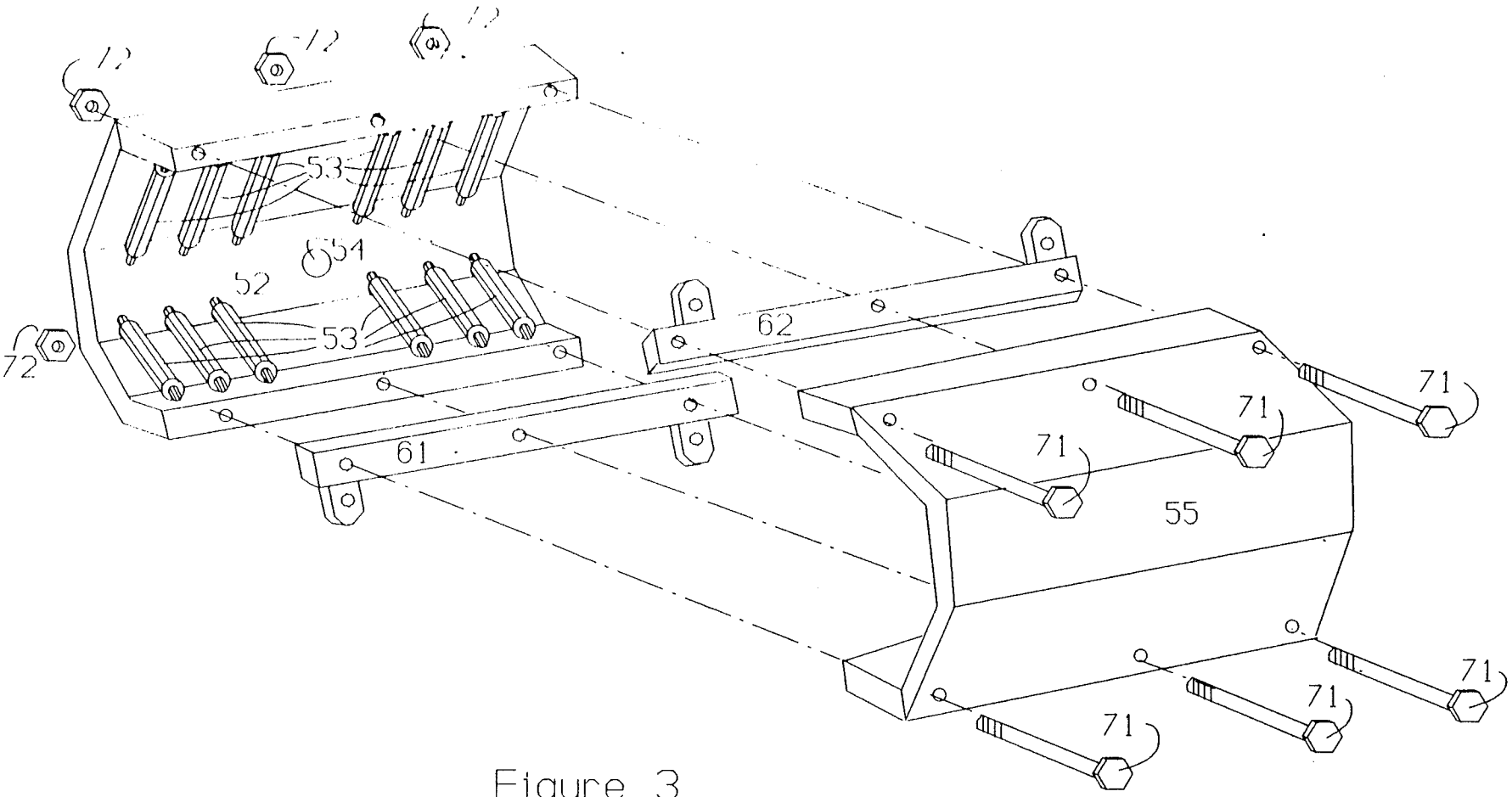
FIG. 3 shows an exploded view of the portion of the present invention, the spinnaker pole shell, which holds the spinnaker pole.
Figure 5:
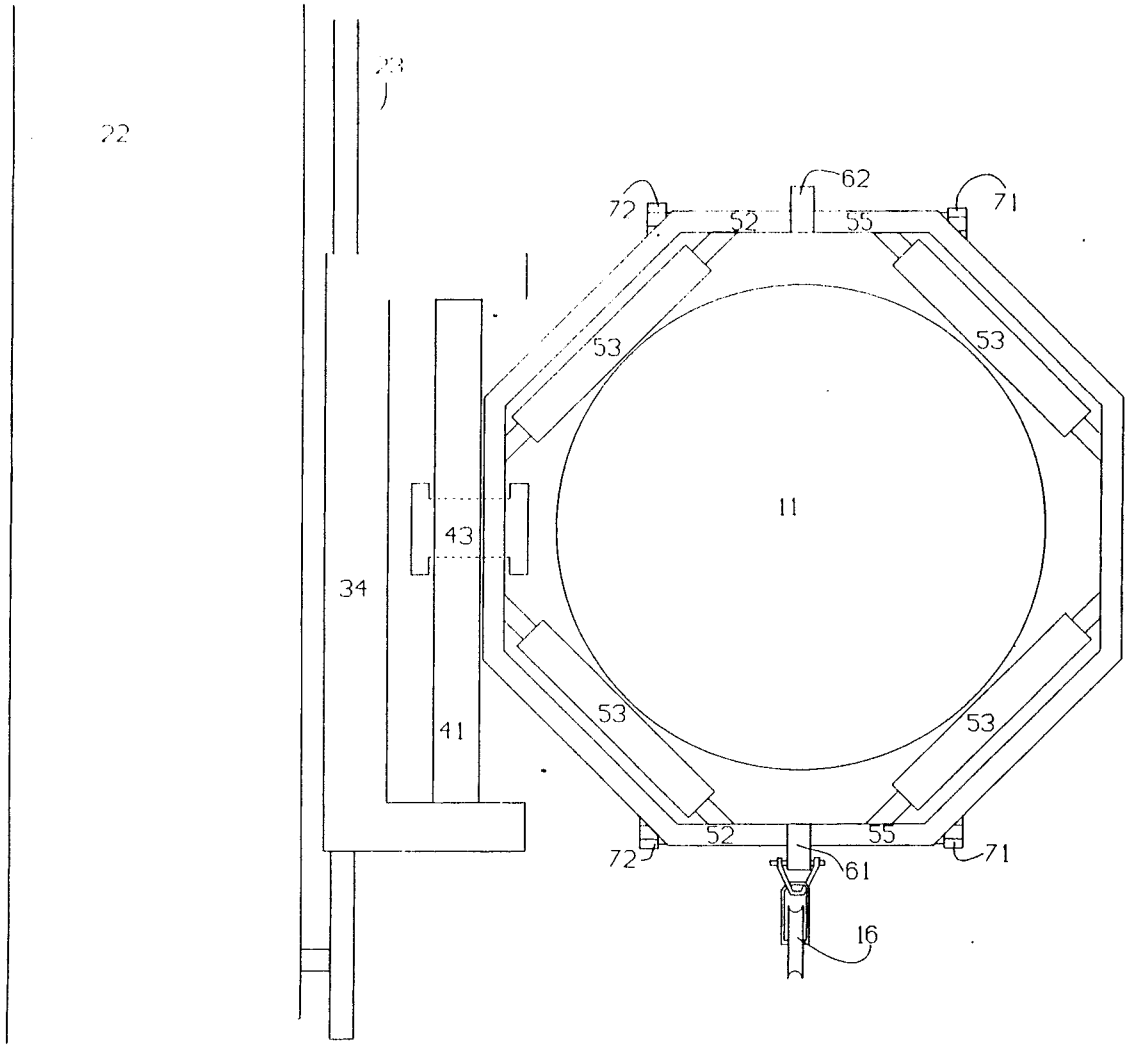
FIG. 5 is a cross sectional view of the spinnaker pole shell and attachment car and the stowage bracket of the present invention viewed along an axis parallel to the spinnaker

The present invention consists of the spinnaker pole shell, a block of a suitable seaworthy structural material, for example aluminum or delrin as shown in FIG. 3, and its associated operating tackle. The block is hollow along its major axis so that it will accommodate the spinnaker pole of the appropriate diameter. The block is cut along a plane parallel to and intersecting the major axis, into halves 52 and 55, to form a shell which can be opened and fitted around the spinnaker pole 11 which is shown in cross section in FIG. 5. Within each half shell, roller bearings, 53 are mounted to permit the spinnaker pole to slide through the spinnaker pole shell freely. At each of the four inner sides of the spinnaker pole shell which are at a 45 degree angle to the horizontal, as shown in FIG. 5, six separate roller bearings are provided across the length of the spinnaker block. The two block halves 52 and 55 are fitted with nuts and bolts or other appropriate fittings, 71 and 72, to hold the halves together with the spinnaker pole inside. Spacers 61 and 62 may be fitted between the spinnaker block halves to allow the pole to slide more easily as well as to accommodate differences in pole diameter.

Roller bearing units are provided across the length of the spinnaker block. The bearings are grouped into two equally spaced sets positioned at the ends of the spinnaker block halves 52 and 55. In practice, the two block halves 52 and 55 are assembled around spinnaker pole 11 by tightening bolts 71 and 72. Spacers, 61 and 62 are provided to accommodate the mounting of the blocks 16 and 17 for the control lines 20 and 21, and pairs of spacers of different thickness may be incorporated to allow the use of spinnaker poles of different cross sectional diameter. By choosing thicker spacers 61 and 62, poles of larger cross sectional diameter may be accommodated. Thinner spacers 61 and 62 permit the present invention to accommodate poles of smaller cross sectional diameter. The spacers 61 and 62 keep the beings from binding on the spinnaker pole 11 when the nuts and bolts 71 and 72 are tightened.

Figure 4A:
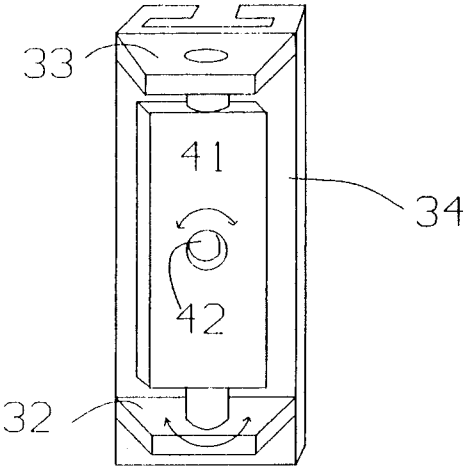
FIG. 4*a* shows a front view of the components of the attachment car which attaches the spinnaker pole shell to the mast.
Figure 4B:
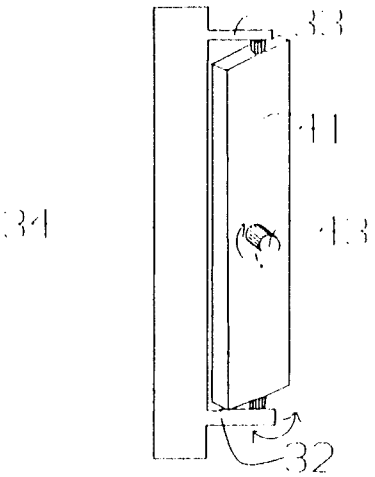
FIG. 4*b* shows a side perspective view of the components of the attachment car which attaches the spinnaker pole shell to the mast.
Figure 4C:
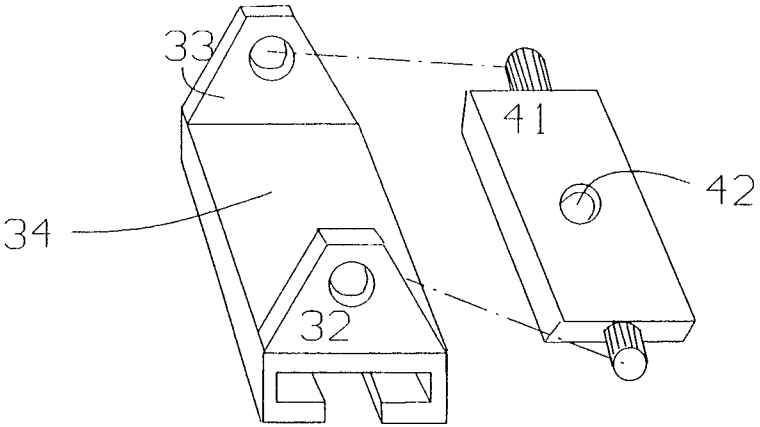
FIG. 4*c* shows an exploded perspective view of the components of the attachment car which attaches the spinnaker pole shell to the mast.
Figure 6:
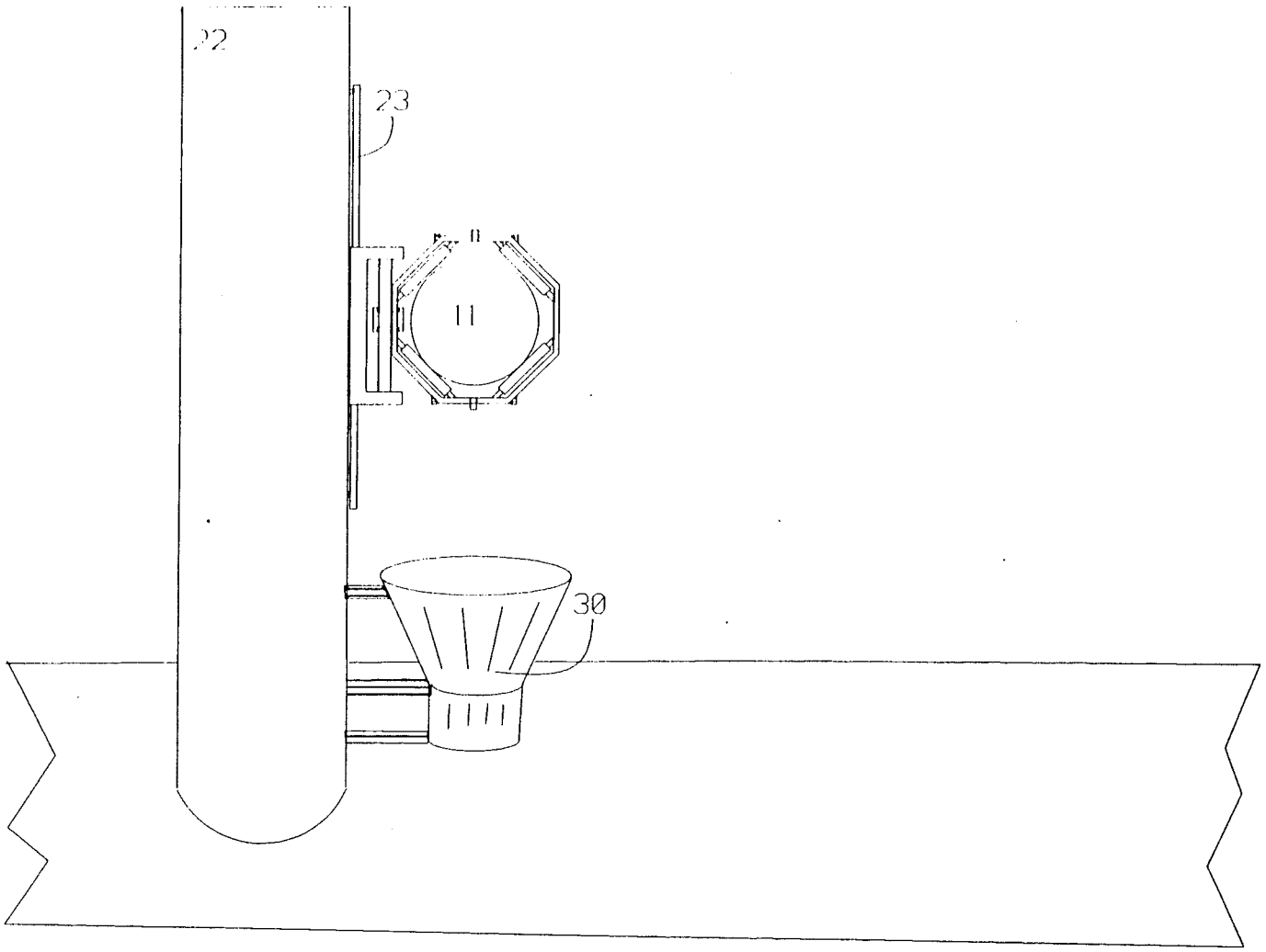
FIG. 6 shows the spinnaker pole shell and attachment car of the present invention as well as the stowage bracket attached to the mast.
Figure 7:
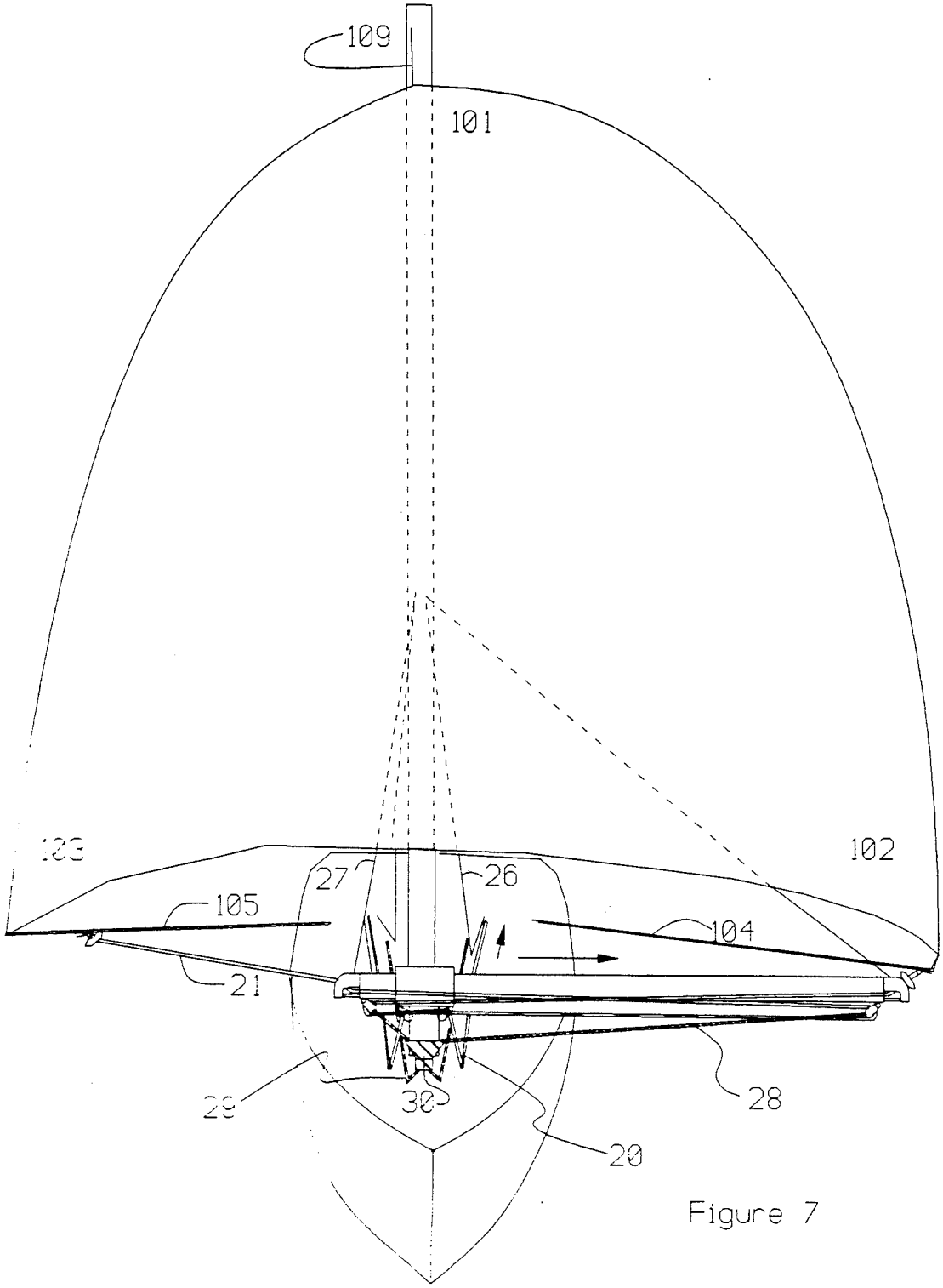
FIG. 7 is a front view of a sailboat showing the present invention mounted thereon and the spinnaker pole extended to the port side of the boat.

The present invention does not use either end cap 12 or 14 of the spinnaker pole to attach the pole to the mast. The pole runs through the spinnaker pole shell which is attached to the mast via the attachment car. The attachment car is more particularly shown in FIGS. 4*a*, 4*b*, and 4*c*. As shown in FIG. 5, the pin 43 which goes through hole 54 in the spinnaker pole shell and hole 42 in the pivot plate 41 of the attachment car 34 connects the spinnaker pole shell to the pivot plate and allows the spinnaker pole shell to rotate in a plane perpendicular to the mast (See FIG. 3 for the location of hole 54 and FIG. 4 for the location of hole 42.) The pivot plate 41 swivel in the attachment car 34 to permit it and the spinnaker pole shell attached to it to pivot on an axis parallel to the mast. FIG. 6 shown the spinnaker pole shell and the stowage bracket 30 attached to the mast 22.

Figure 13:
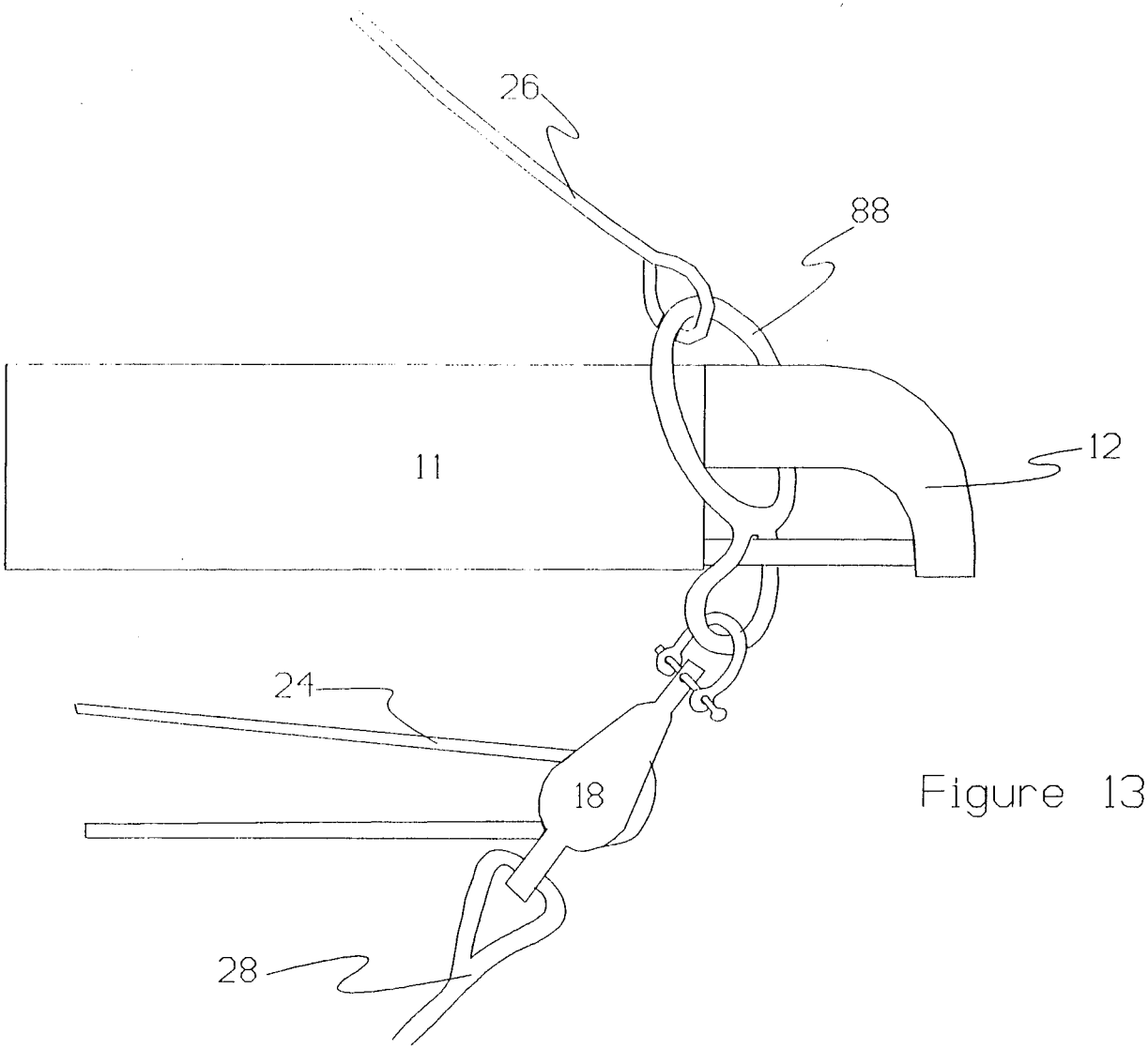
FIG. 13 shows the end of a spinnaker pole with a close up view of a "crazy eight" attachment apparatus.

The rigging of the spinnaker pole shell and pole arrangement is particularly shown in FIGS. 7 through 10. The spinnaker pole is made to slide through the spinnaker block by means of control lines 20 and 21, which move the pole and also assist in controlling the spinnaker sheets: An ordinary spinnaker pole 11 is adapted for use with the present invention by the addition of the "crazy eight" fittings 88 as shown in FIG. 13. This fitting has a larger and a smaller chamber joined together to form a shape similar to the number "8" when viewed looking towards the chamber openings. The two chambers are joined at an angle, when viewed from the side. A "crazy eight" fitting is attached to each standard end cap 12 and 14 of the spinnaker pole by inserting the main portion of the body of the spinnaker end cap through the larger chamber of the "crazy eight" fitting and inserting the pin of the spinnaker pole end cap into the smaller chamber as shown in FIG. 13. The port and starboard topping lifts 26 and 27 are attached to the larger chamber of the fitting on the corresponding side of the spinnaker pole. Similarly, the blocks 15 and 18 for the port and starboard spinnaker pole control lines are attached to the smaller chambers of the fitting on the respective sides of the spinnaker pole. (The downhauls are attached to beckets on blocks 15 and 18.) The end cap of the spinnaker pole consists of a three sided, u-shaped structure which is solid on three sides and is provided with a retractable pin which closes the u-shaped portion to form a closed chamber. The "crazy eight" fittings prevent the blocks and topping lifts from falling away from the end cap should the end cap pin be inadvertently withdrawn opening up the end cap chamber. Alternatively, the "crazy eight" fittings 88 can be omitted and the shackles attached directly to the end caps. The spinnaker control sheets are not fed through the chambers in the end caps of the spinnaker pole, rather, the control lines are fed through those chambers, and the spinnaker sheets are fed through snap shackles at the end of each control line. Starboard control line 21 is attached to the sheet leading to the starboard corner of the spinnaker sail 103 and a stopper 24 is placed just below this junction. From this point, line 21 passes through end cap 14 and may be hauled through this opening until stopper 24 abuts against end cap 14. Control line 21 then runs the length of spinnaker pole 11 through block 18 attached to port end cap 12, and then through pulley 17 attached to spinnaker pole shell 13 and then it is muted back to the cockpit. Port control line 20 takes a similar course through end cap 12, through pulley 15 attached to starboard end cap 14, through pulley 16 attached to spinnaker pole shell 13 and then it too is led back to the cockpit.

Figure 8:
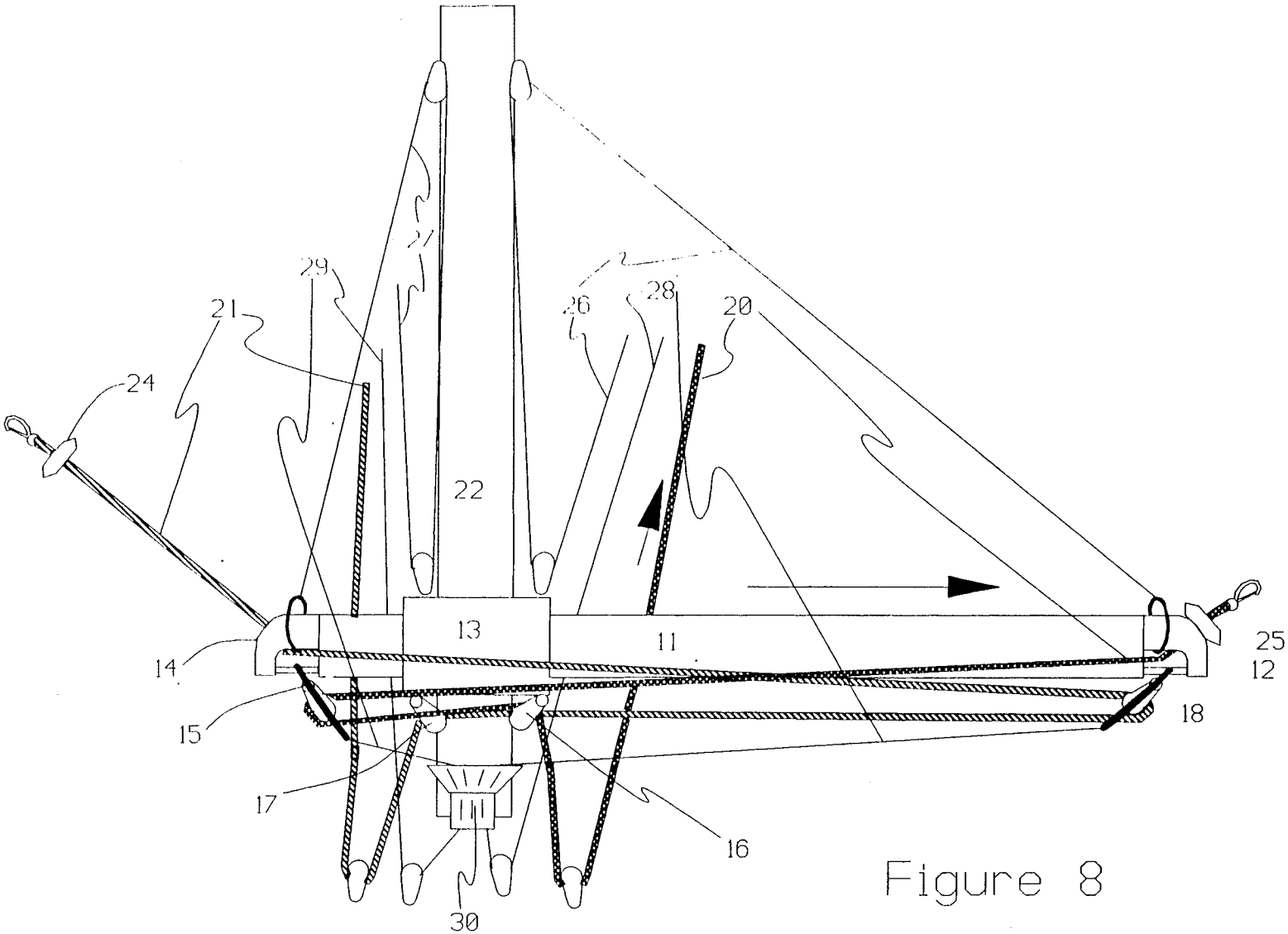
FIG. 8 shows a closer view of the spinnaker pole positioned as in FIG. 7, with the spinnaker, its sheets and the boat omitted.
Figure 9:
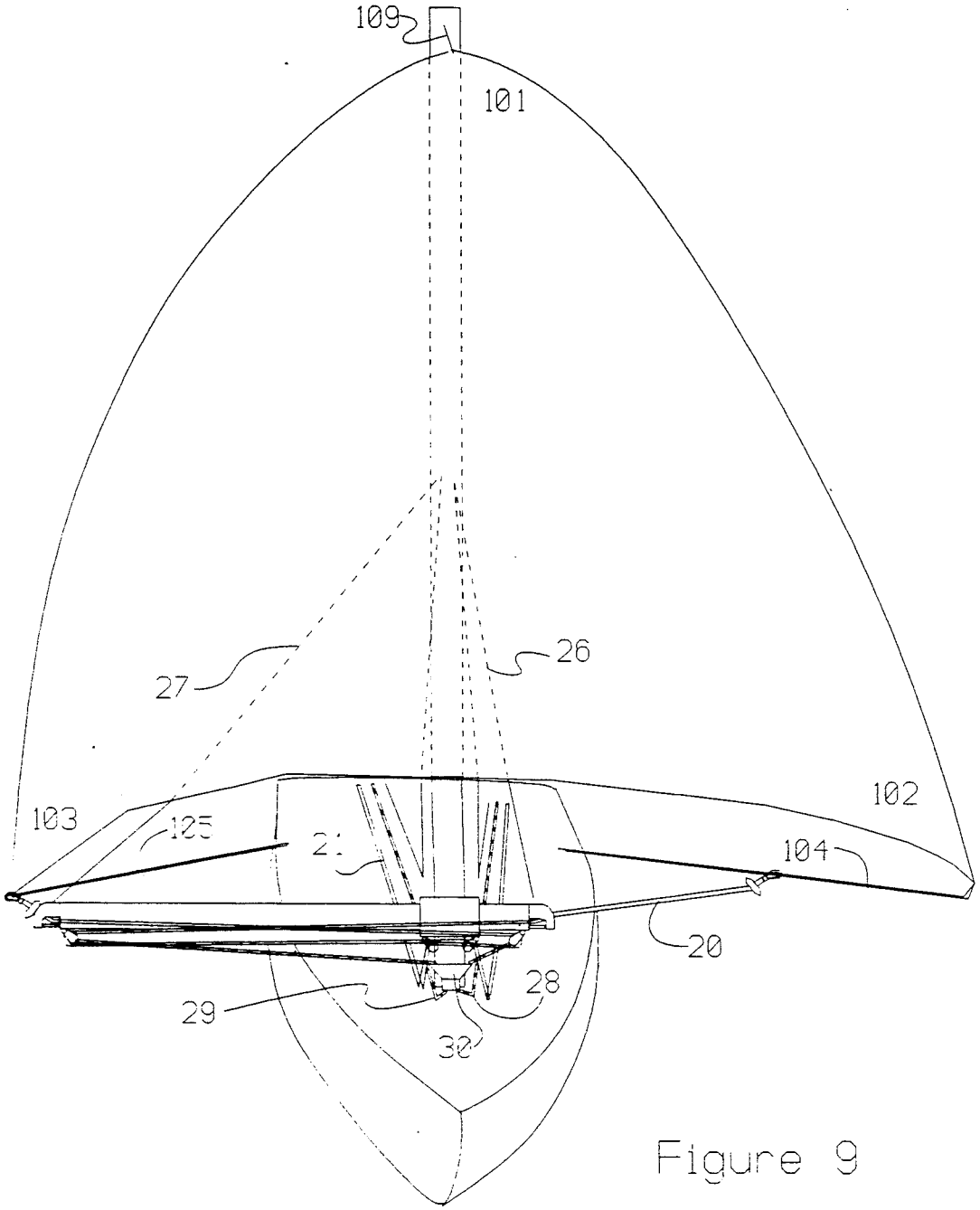
FIG. 9 is a front view of a sailboat showing the present invention mounted thereon and the spinnaker pole extended to the starboard side of the boat.
Figure 10:
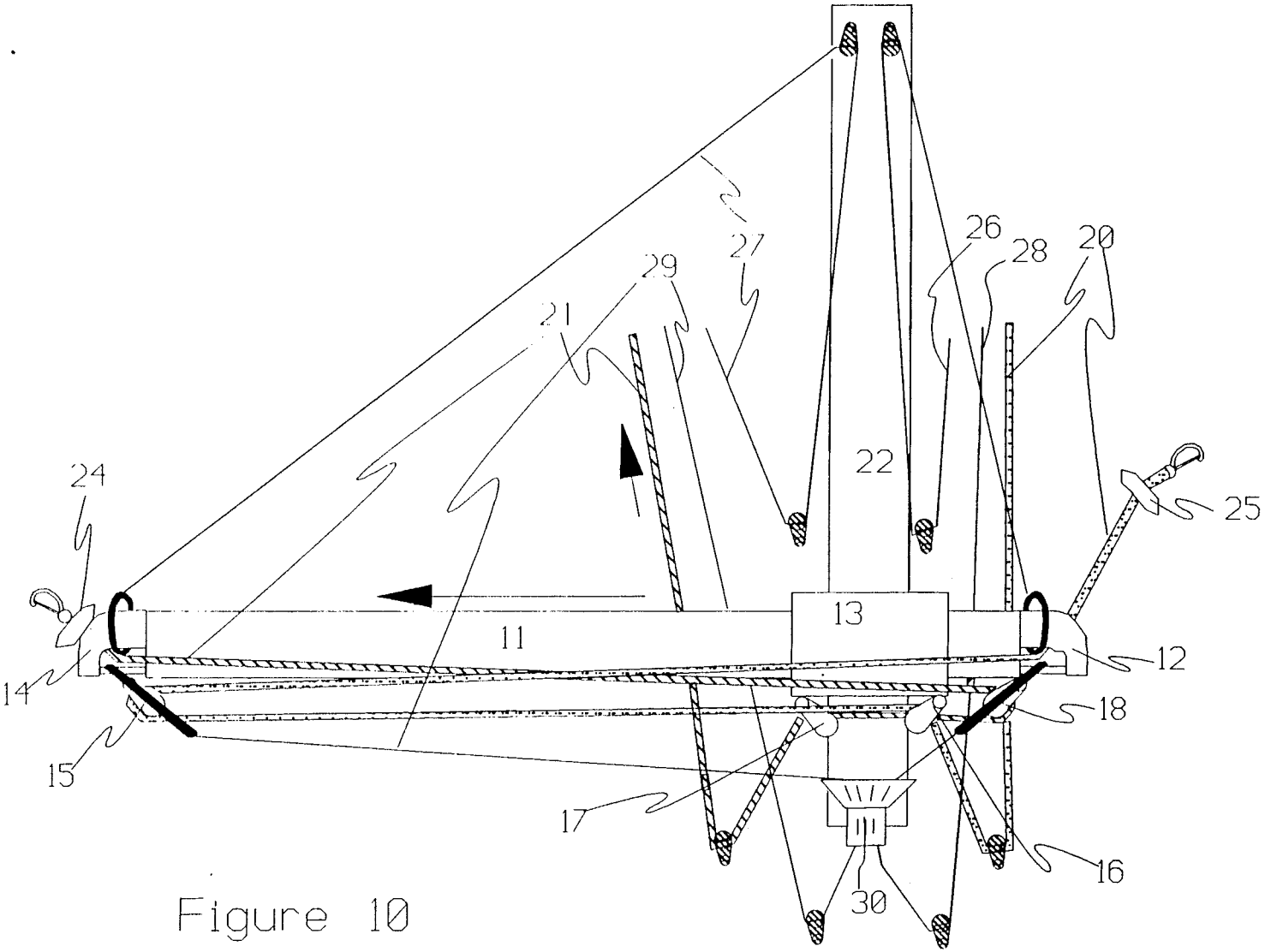
FIG. 10 shows a closer view of the spinnaker pole positioned as in FIG. 9, with the spinnaker, its sheets and the boat omitted.

In order to appreciate the operation of the present invention, the movement of spinnaker pole 11 through the spinnaker pole shell will be described with respect to FIGS. 8 and 10. When spinnaker pole 11 is extended to the starboard side of the boat, tension on the starboard control line 21 keeps the pole extended. In order to extend the pole to the port side of the boat, the tension on the starboard control line 21 is released, and the port control line 20 is hauled in. The outboard end of the port control line 20 is attached to the port spinnaker sheet 104. At this juncture stopper 25 prevents the end of control line 20 from coming through port end cap 12. When the port control line 20 is hauled in, as shown in FIG. 8, the free end comes in until it is halted when the stopper 25 hits the port end cap 12. Hauling in on the line further causes the spinnaker pole to slide through the spinnaker pole shell 13 to port, until the pulley block 15 on the starboard end cap 14 is drawn all the way to pulley 16 fitted to the spinnaker pole shell 13. At that time, the pole is fully extended to the port side of the boat, as shown in FIG. 8. The port spinnaker sheet is held close to the port end of the spinnaker pole by control line 20. The starboard spinnaker sheet 105 is allowed to extend away from the starboard end of the spinnaker pole 11 by removing tension from the starboard control line 21. The fullness of the spinnaker sail may be adjusted by changing the tension on the control line opposite the side hauled in.

A minor image control arrangement exists for the starboard control line 21. To move the pole to starboard, the port control line 20 is slacked off and the starboard control line 21 is hauled in. This operation represents the reverse of the procedures described with respect to the movement of the spinnaker pole to the port side and will not be repeated here. It is however, illustrated in FIG. 10.

Figure 1:
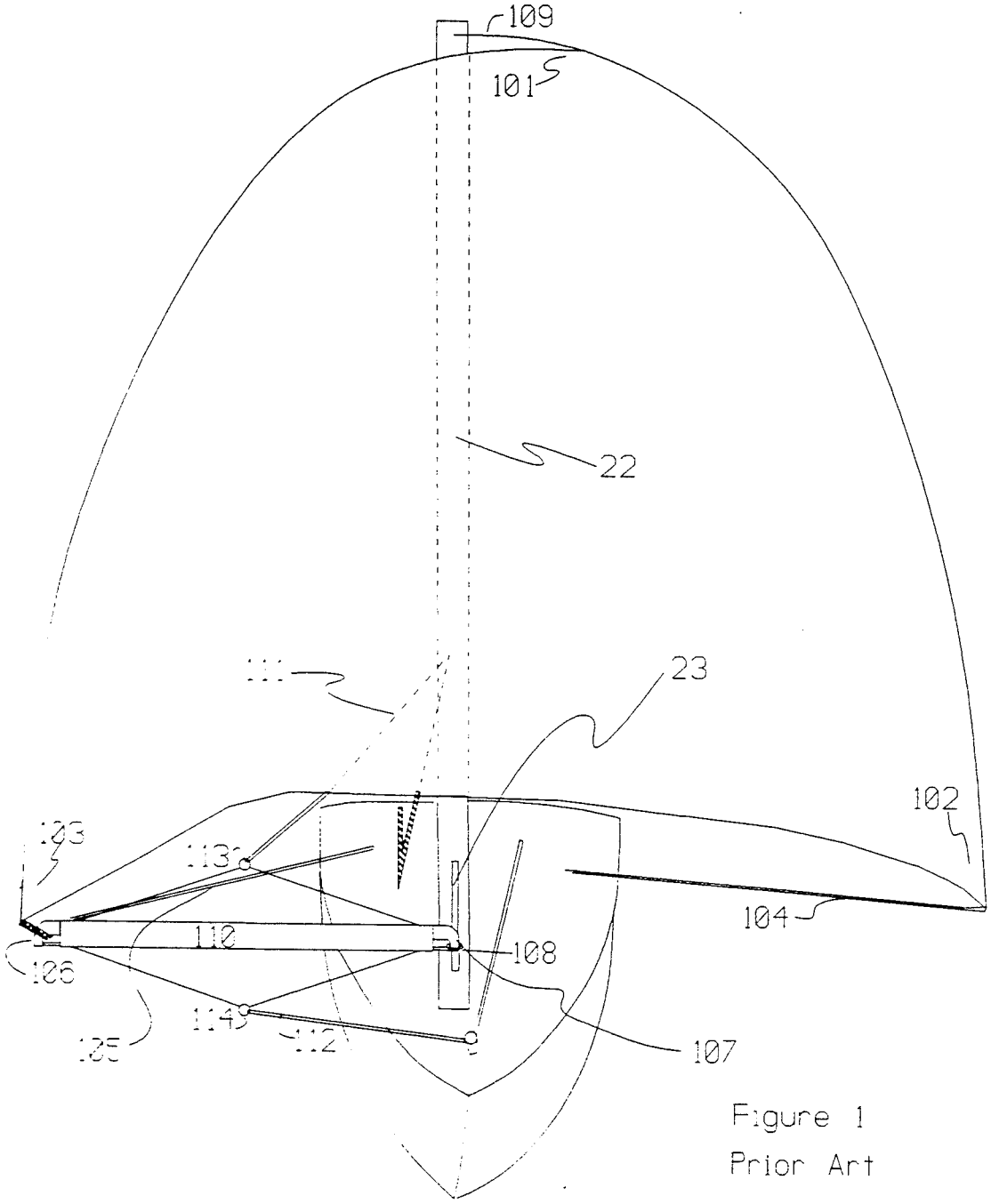
Figure 1 Prior Art
FIG. 1 is a front view of a sailboat showing the prior art.
Figure 2:
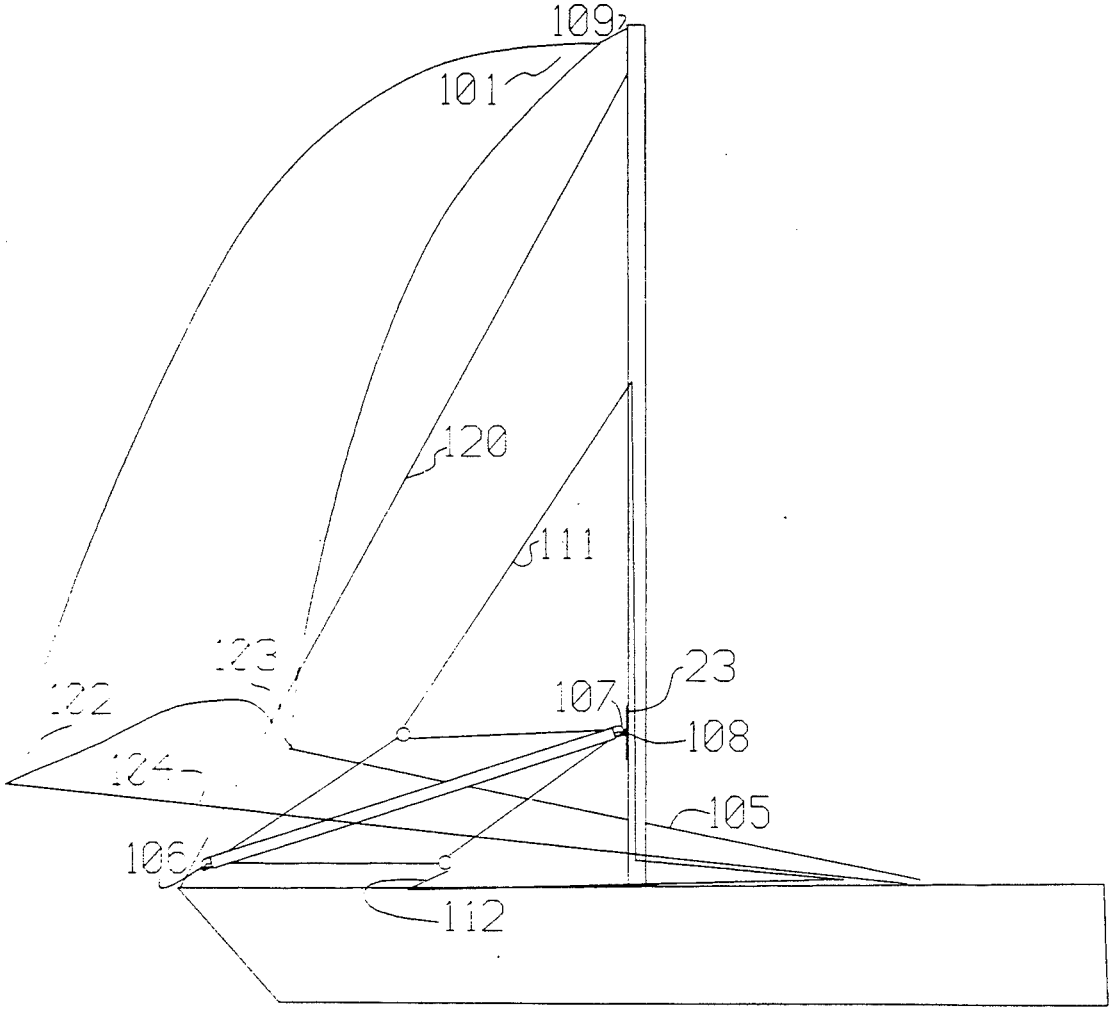
Figure 2 Prior Art
FIG. 2 is a side view of a sailboat showing the prior an as seen in a "dip pole" gybe.

The present invention permits a freedom and ease of movement of the spinnaker pole not present in the prior art. When spinnaker pole 11 is extended to the port side, the height of the spinnaker pole may be adjusted using the port side topping lift 26 and downhaul 28. When the spinnaker pole is extended to the starboard side, the height of the spinnaker pole may be adjusted using the starboard side topping lift 27 and downhaul 29. The topping lift and downhauls may be attached normally to the bridles 113 and 114 of the spinnaker pole as in the prior art, FIG. 1. In this case, trimming the height of spinnaker pole is accomplished normally using a single topping lift 111 and downhaul 112 and the port and starboard topping lifts and downhauls 26, 27, 28, and 29 are eliminated. The optional feature of vertical stowage of the spinnaker is not supported in this configuration. When this is done, the spinnaker pole shell pivots on pin 43, allowing the free end of the spinnaker pole to raise of lower as desired. When the spinnaker pole is trimmed forward or aft, by easing out or hauling in on the spinnaker sheet, the pivot plate 41 pivots on its vertical axis in the attachment car allowing the free end of the spinnaker pole to swing forward or aft as desired. The swiveling mounting 32 and 33 holds the spinnaker pole shell away from the mast 22 to provide sufficient clearance to permit this swing without interference from the mast.

By using the control lines, a variation of the end for end gybe is accomplished without the need for detaching the pole from the mast, without the need for attaching or detaching the sheets and without the need for a crewmember on the foredeck. As the boat is swung through the wind, the leeward control line is eased and the windward control line is hauled in. This pulls the pole through the spinnaker pole shell and puts the opposite end of the pole outboard.

Figure 11:
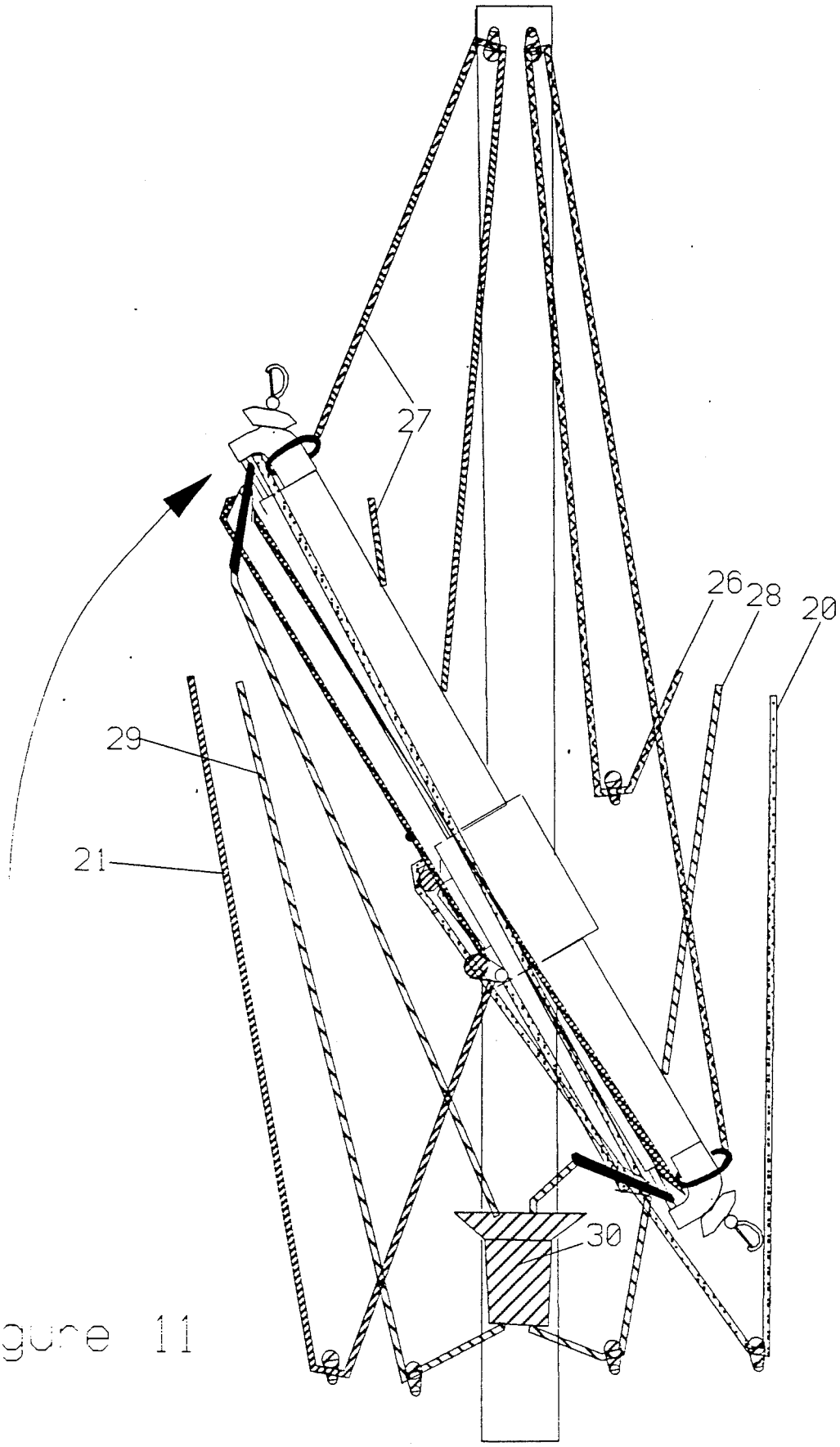
FIG. 11 shows the spinnaker pole being swung into the vertical position prior to stowage.
Figure 12:
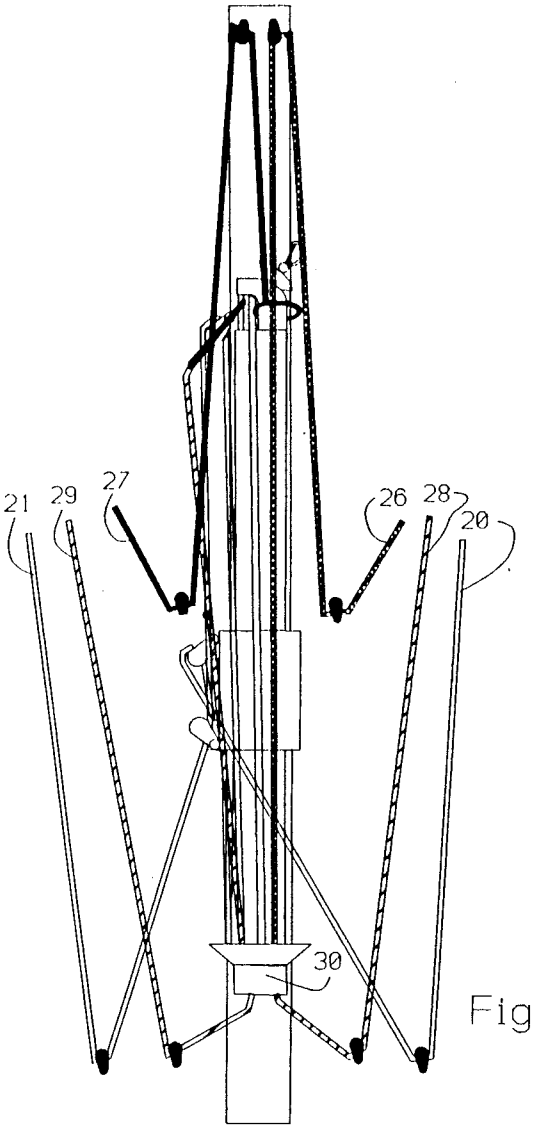
FIG. 12 shows the spinnaker pole in the vertical position stowed.

In the optimum configuration, downhauls 29 and 28 and topping lifts 27 and 26 are attached to the end caps of the spinnaker pole. In an optimum configuration, this is done using the "crazy eight" fittings 88. Use of these fittings insures that the control lines and associated tackle remain in place on the pole end cap in the event that the pin in the pole end cap is inadvertently withdrawn. Each side may be adjusted independently. These are also used for stowing and unstowing the pole. When the spinnaker is doused, the spinnaker pole may be stowed vertically. FIGS. 11 and 12 show this operation. This is accomplished by hauling in on the topping lift 27 on the outboard side of the spinnaker pole until the pole is vertical. Then the downhaul 28 on the inboard end of the spinnaker is hauled in while the topping lift 27 is eased out allowing the inboard end of the spinnaker pole to settle into the stowage bracket 30. In this configuration, the downhauls are fed through the stowage bracket 30 along the bottom of the mast and parallel to it. When the downhaul is hauled in, the inboard end of the spinnaker pole will be drawn into the sleeve of the stowage bracket. The stowage bracket and the present invention form two points of attachment for the spinnaker pole, and the free end may be tensioned and held fast by the topping lift.

In a preferred embodiment, the present invention consists of an apparatus for controlling, manipulating, and storing a spinnaker pole of constant cross section comprising a shell having first and section half sections disposed around said spinnaker pole; spacers disposed between said first and second half sections; bolt attachment means for rigidly joining said first and second half sections around said spinnaker pole and for fixedly holding said spacers between said first and second half sections; anti-friction rollers disposed on the inner surface of said shell and adapted to bear against said spinnaker pole for facilitating the movement of said spinnaker pole within said shell along the longitudinal axis of said spinnaker pole; a track mechanism attached to the mast of a sailing vessel; a swiveling element for attaching said shell to said track mechanism; a tapered receptacle for receiving one end of said spinnaker pole; and a system of tackle comprising control lines and turning blocks linking said spinnaker pole to a remote location on the sailing vessel. The rollers may comprise elongated roller bearings disposed at ninety degree intervals around the interior of said shell. The spacers may advantageously include elements of different thicknesses to permit said shell to accommodate spinnaker poles of different cross sectional dimensions. The system of tackle may advantageously include a first control line linking said remote location on the sailing vessel to said spinnaker pole for drawing said spinnaker pole in a starboard direction; and a second control line linking said remote location on the sailing vessel to said spinnaker pole for drawing said spinnaker pole in a port direction. The system of tackle further comprises third and fourth control lines linking said remote location on the sailing vessel to said spinnaker pole for adjusting the vertical height of the starboard end of said spinnaker pole; and fifth and sixth control lines linking said remote location on the sailing vessel to said spinnaker pole for adjusting the vertical height of the port end of said spinnaker pole. The system of tackle may also include a rigging link having first and second chambers; said first chamber disposed about the end of said spinnaker pole; wherein a turning block connected to one of said first or second control lines is attached to said first chamber; and one pair of said third and fourth or fifth and sixth control lines is attached to said second chamber. The swivel element is adapted to permit said shell to rotate about an axis perpendicular to said mast.

Alternatively, the present invention consists of an apparatus for controlling, manipulating, and storing a spinnaker pole of constant cross section including a shell having first and section half sections disposed about said spinnaker pole; anti-friction bearing means disposed on the inner surface of said shell and adapted to bear against said spinnaker pole for facilitating the movement of said spinnaker pole within said shell along the longitudinal axis of said spinnaker pole; a said mechanism attached to the mast of a sailing vessel; means for attaching said shell to said track mechanism; a tapered receptacle for receiving one end of said spinnaker pole; a system of tackle comprising control lines with associated blocks and termination hardware comprising, at least one control line for controlling the downward movement of the starboard end of the spinnaker pole, at least one control line for controlling the downward movement of the port end of the spinnaker pole; at least one control line for controlling the upward movement of the starboard end of the spinnaker pole, at least one control line for controlling the upward movement of the port end of the spinnaker pole, at least one control line for moving the spinnaker pole through the sleeve in the starboard direction, and at least one control line for moving the spinnaker pole through the sleeve in the port direction; a first fitting disposed at the starboard end of said spinnaker pole adapted to receive one or more of said control lines; and a second fitting disposed at the port end of said spinnaker pole adapted to receive one or more of said control lines. This embodiment of the invention may advantageously include means for attaching said shell to said track which includes a pivot plate; a pin connecting the sleeve to the pivot plate which permits the sleeve to rotate about the axis of the pin; and a car which rides on the track and can be fixed at specific positions on the track and holds the pivot plate so that the pivot plate may rotate on an axis parallel to the mast.

A further embodiment of the present invention consists of an apparatus for controlling, manipulating, and storing a spinnaker pole for use on sailing vessels having a vertical mast comprising a spinnaker pole of constant cross section; a spinnaker pole shell disposed around said spinnaker pole for slidably receiving said spinnaker pole; roller means disposed between the inner surface of said spinnaker pole block and the outer surface of said spinnaker pole for facilitating the longitudinal movement of said spinnaker pole with respect to said spinnaker pole block; swivel means for attaching said spinnaker pole block to said mast; control line means comprising a plurality of control lines for permitting remote manipulation of said spinnaker pole from a remote location on said sailing vessel; and a two chambered fitting having first and second chambers adapted to receive at least one of said control line in each of said first and second chambers. This embodiment may aim include a first cap disposed on one end of said spinnaker pole having a u-shaped structure having three sides; a retractable pin provided in said first cap for closing said u shaped structure to fore a closed chamber; and a two chambered fitting wherein said first chamber of said two chambered fitting is disposed about one side of said u-shaped structure, and said second chamber of said two chambered fitting is disposed about said retractable pin.

SUMMARY OF THE MAJOR ADVANTAGES

The present invention possesses many unique and substantial advantages. A primary advantage of the invention is its structures which permit maneuvering of a boat under a spinnaker sail easily and efficiently. A specific advantage of the invention is its structures which permit gybing of spinnaker without detachment of the spinnaker pole from the mast. A further advantage of the invention is its ability to conduct a spinnaker gybe without a crewperson foredeck. A further advantage is the provision for a singlehanded gybe by a lone sailor without leaving the cockpit. A further advantage is the ability of the present invention to accomplish a gybe without detaching the spinnaker sheet from the spinnaker pole and reattaching the sheet to the pole. A further advantage of the invention is that it allows the spinnaker pole to be stowed vertically next to mast. A still further advantage of the present invention lies in the ease of movement of the spinnaker pole during gybe maneuvers. Another advantage of the present invention lies in the unique support structure of the spinnaker pole shell which may accommodate spinnaker poles of different diameters. A still further advantage of the present invention lies in the accommodation of ordinary spinnaker poles within the system of the present invention reducing the overall cost to the user. A still further advantage of the present invention lies in the accommodation of varying length spinnaker poles within the system of the present invention. A still further advantage of the present invention lies in the ease of installation of standard spinnaker poles within the system of the present invention. The above advantages increase safety and efficiency of spinnaker operations in stark contrast to prior art systems.

It should be appreciated that there has been disclosed in accordance with the present invention, the preferred embodiment of the spinnaker gybing apparatus of the present invention. It is evident that many alternatives, common modifications, and variations would be apparent to one of ordinary skill in the art in light of the description set forth herein. Accordingly, the present invention is intended to embrace all such alternatives, modifications, and variations that fall within the spirit and broad scope of the following appended claims.

I claim:

1. An apparatus for controlling, manipulating, and storing a spinnaker pole of constant cross section comprising:

a shell having first and section half sections disposed around said spinnaker pole;

spacers disposed between said first and second half sections;

bolt attachment means for rigidly joining said first and second half sections around said spinnaker pole and for fixedly holding said spacers between said first and second half sections;

anti-friction milers disposed on the inner surface of said shell and adapted to bear against said spinnaker pole for facilitating the movement of said spinnaker pole within said shell along the longitudinal axis of said spinnaker pole;

a track mechanism attached to the mast of a sailing vessel;

a swiveling dement for attaching said shell to said track mechanism;

a tapered receptacle for receiving one end of said spinnaker pole; and a system of tackle comprising control lines and turning blocks linking said spinnaker pole to a remote location on the sailing vessel.

2. The apparatus of claim 1 wherein said rollers comprise elongated roller bearings disposed at ninety degree intervals around the interior of said shell.

3. The apparatus of claim 1 wherein said spacers comprise elements of different thicknesses to permit said shell to accommodate spinnaker poles of different cross sectional dimensions.

4. The apparatus of claim 1 wherein said system of tackle comprises:

a first control line linking said remote location on the sailing vessel to said spinnaker pole for drawing said spinnaker pole in a starboard direction; and a second control line linking said remote location on the sailing vessel to said spinnaker pole for drawing said spinnaker pole in a port direction.

5. The apparatus of claim 4 wherein said system of tackle further comprises:

third and fourth control lines linking said remote location on the sailing vessel to said spinnaker pole for adjusting the vertical height of the starboard end of said spinnaker pole; and fifth and sixth control lines linking said remote location on the sailing vessel to said spinnaker pole for adjusting the vertical height of the port end of said spinnaker pole.

6. The apparatus of claim 4 wherein said system of tackle further comprises:

a rigging link having first and second chambers;

said first chamber disposed about the end of said spinnaker pole;

wherein a turning block connected to one of said first or second control lines is attached to said first chamber; and one pair of said third and fourth or fifth and sixth control lines is attached to said second chamber.

7. The apparatus of claim 1 wherein said swivel element is adapted to permit said shell to rotate about an axis perpendicular to said met.

8. An apparatus for controlling, manipulating, and storing a spinnaker pole of constant cross section comprising:

a shell having first and section half sections disposed about said spinnaker pole;

anti-friction bearing means disposed on the inner surface of said shell and adapted to bear against said spinnaker pole for facilitating the movement of said spinnaker pole within said shell along the longitudinal axis of said spinnaker pole;

a track mechanism attached to the mast of a sailing vessel;

means for attaching said shell to said track mechanism;

a tapered receptacle for receiving one end of said spinnaker pole;

a system of tackle comprising control lines with associated blocks and termination hardware comprising, at least one control line for controlling the downward movement of the starboard end of the spinnaker pole, at least one control line for controlling the downward movement of the port end of the spinnaker pole;

at least one control line for controlling the upward movement of the starboard end of the spinnaker pole, at least one control line for controlling the upward movement of the port end of the spinnaker pole, at least one control line for moving the spinnaker pole through said shell in the starboard direction, and at least one control line for moving the spinnaker pole through said shell in the port direction;

a first fitting disposed at the starboard end of said spinnaker pole adapted to receive one or more of said control lines; and a second fitting disposed at the port end of said spinnaker pole adapted to receive one or more of said control lines.

9. The apparatus of claim 8 wherein said means for attaching said shell to said track comprises:

a pivot plate;

a pin connecting said shell to the pivot plate which permits said shell to rotate about the axis of the pin; and a car which rides on the track and can be fixed at specific positions on the track and holds the pivot plate so that the pivot plate may rotate on an axis parallel to the mast.

10. An apparatus for controlling, manipulating, and storing a spinnaker pole for use on sailing vessels having a vertical mast comprising:

a spinnaker pole of constant cross section;

a spinnaker pole shell disposed around said spinnaker pole for slidably receiving said spinnaker pole said shell comprising;

a plurality of sections joined along line segments substantially parallel to the longitudinal axis of said shell;

means for joining said sections around said spinnaker pole;

roller means disposed between the inner surface of said shell and the outer surface of said spinnaker pole for facilitating the longitudinal movement of said spinnaker pole with respect to said shell; and means for attaching said shell to said mast.

11. The apparatus of claim 10 further comprising:

control line means comprising a plurality of control lines for permitting remote manipulation of said spinnaker pole from a remote location on said sailing vessel;

a first fitting attached to one end of said spinnaker pole and adapted to receive said control line means and connect said control line means to said spinnaker pole a second fitting attached to the other end of said spinnaker pole and adapted to receive said control line means and connect said control line means to said spinnaker pole;

said first and second fittings comprising, a first cap having a u-shaped structure having three sides;

a retractable pin provided in said first cap for closing said u-shaped structure to form a closed chamber;

a two chambered fitting having first and second chambers;

said first chamber encircling the side of said u-shaped structure opposite the retractable pin; and said second chamber encircling said retractable pin.

* * * * *